US011528967B2

(12) United States Patent
Kanno et al.

(10) Patent No.: US 11,528,967 B2
(45) Date of Patent: Dec. 20, 2022

(54) MALE SNAP BUTTON AND FEMALE SNAP BUTTON

(71) Applicant: YKK CORPORATION, Tokyo (JP)

(72) Inventors: Kota Kanno, Tokyo (JP); Kazunori Somai, Tokyo (JP); Daisuke Hayashi, Tokyo (JP); Kohei Iwata, Tokyo (JP); Nariko Kubota, Tokyo (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 17/295,868

(22) PCT Filed: Nov. 22, 2018

(86) PCT No.: PCT/JP2018/043289
§ 371 (c)(1),
(2) Date: May 20, 2021

(87) PCT Pub. No.: WO2020/105194
PCT Pub. Date: May 28, 2020

(65) Prior Publication Data

US 2022/0007794 A1 Jan. 13, 2022

(51) Int. Cl.
*A44B 17/00* (2006.01)

(52) U.S. Cl.
CPC ..... *A44B 17/0041* (2013.01)

(58) Field of Classification Search
CPC ..... A44B 17/0041; A44B 17/0076; A44B 17/0088; A44B 17/007
See application file for complete search history.

(56) References Cited

U.S. PATENT DOCUMENTS 3,457,601 A * 7/1969 Prym ..... A44B 17/0005 24/104
3,466,714 A * 9/1969 Nysten ..... A44B 17/0035 24/692

(Continued)

FOREIGN PATENT DOCUMENTS

CN 101541201 9/2009
CN 102159107 8/2011

(Continued)

OTHER PUBLICATIONS

"International Search Report (Form PCT/ISA/210) of PCT/JP2018/043289," dated Jan. 15, 2019, with English translation thereof, pp. 1-2.

(Continued)

*Primary Examiner* — David M Upchurch
(74) *Attorney, Agent, or Firm* — JCIPRNET

(57) ABSTRACT

Provided is a male snap button (10) including a metal male snap body (20), and a fixing member (30) for fixing the male snap body (20) to a fabric (1). The male snap body (20) includes: a male-side engagement part (21) in annular shape capable of being removably engaged with a female-side engagement part (60) of a female snap button (40); and multiple claws (27). The male-side engagement part (21) defines an opening (28) that exposes the fabric (1) inside in a radial direction thereof. A diameter (D1) of the opening (28) is greater than a length (W1) in the radial direction from an outside edge of the opening (28) in the radial direction to an outside edge of the male snap body (20) in the radial direction. The fixing member (30, 30*a*) includes claw accommodation parts (33) to receive the claws (27).

5 Claims, 13 Drawing Sheets

(56) References Cited

U.S. PATENT DOCUMENTS

| | | | | | |
|---|---|---|---|---|---|
| 3,975,803 | A * | 8/1976 | Katayama | A44B 17/0011 | 24/689 |
| 4,641,401 | A * | 2/1987 | Hasegawa | A44B 17/0076 | 24/108 |
| 4,751,773 | A * | 6/1988 | Nysten | A44B 17/0029 | 411/339 |
| 4,967,452 | A * | 11/1990 | Watanabe | A44B 1/08 | 24/94 |
| 10,194,718 | B2 * | 2/2019 | Raccosta | A44B 17/0017 | |
| 2005/0223527 | A1 * | 10/2005 | Raccosta | A44B 17/0088 | 24/90.1 |
| 2009/0113678 | A1 * | 5/2009 | Shimizu | A44B 17/0076 | 24/691 |
| 2014/0137373 | A1 * | 5/2014 | Villa | A44B 17/0023 | 24/108 |
| 2015/0320151 | A1 * | 11/2015 | Raccosta | A44B 17/0076 | 24/630 |

FOREIGN PATENT DOCUMENTS

| | | |
|---|---|---|
| CN | 103717101 | 4/2014 |
| CN | 204378085 | 6/2015 |
| IT | BO20100187 | 9/2011 |
| JP | S6253605 | 3/1987 |
| JP | H0661289 | 8/1994 |
| JP | 2015221205 | 12/2015 |
| JP | 6253605 | 12/2017 |
| WO | 2018029765 | 2/2018 |

OTHER PUBLICATIONS

"Search Report of Europe Counterpart Application", dated May 24, 2022, p. 1-p. 8.

Office Action of China Counterpart Application, with English translation thereof, dated Apr. 27, 2022, pp. 1-16.

Office Action of China Counterpart Application, with English translation thereof, dated Nov. 2, 2022, pp. 1-10.

* cited by examiner

MALE SNAP BUTTON AND FEMALE SNAP BUTTON

CROSS-REFERENCE TO RELATED APPLICATION

This application is a 371 application of the international PCT application serial no. PCT/JP2018/043289, filed on Nov. 22, 2018. The entirety of each of the above—mentioned patent applications is hereby incorporated by reference herein and made a part of this specification.

TECHNICAL FIELD

The present invention relates to a male snap button and a female snap button, and particularly to a male snap button and a female snap button which each include a plurality of claws to be crimped after the claws penetrate fabric such as clothes and which are basically made of a metal.

BACKGROUND ART

A metal snap button including a plurality of claws is disclosed in, for example, PCT International Publication No. WO2018/029765 (Patent Literature 1) and the like. The snap button of Patent Literature 1 is constituted by a male or female snap body (a snap body) including a male-side or female-side engagement part and a fixing member, the fixing member is provided with a plurality of claws, and the snap body is provided with a claw accommodation part which receives the plurality of claws. In a case in which the snap body and the fixing member are attached to fabric, the claws of the fixing member penetrate the fabric, and then the claws are accommodated in the claw accommodation part while being crimped, and thus the snap body is fixed to the fabric together with the fixing member. However, since this snap button is provided with the claw accommodation part on the snap body side, there is a problem that a thickness (a height) of the snap body on the fabric is increased by a thickness of the claw accommodation part.

Japanese Examined Patent Application Publication No. H6-61289 (Patent Literature 2) discloses a female snap button in which a plurality of claws is provided on a snap body side. In this female snap button, by providing a claw accommodation part on a fixing member side, it is possible to reduce a thickness of the snap body on fabric.

The fabric is partially hidden by the snap button being attached to the fabric such as clothes, but there is a demand to make a portion of the fabric which is hidden as small as possible so that the fabric is more noticeable or the snap button is less noticeable. Such a demand is realized by a resin snap button formed by injection molding a resin on the fabric. However, practically, the demand is not realized in a metal snap button which is basically made of a metal.

CITATION LIST

Patent Literature

[Patent Literature 1] PCT International Publication No. WO2018/029765

[Patent Literature 2] Japanese Examined Patent Application Publication No. H6-61289

SUMMARY OF INVENTION

Technical Problem

Therefore, an objective of the present invention is to provide a male snap button and a female snap button which can make fabric more noticeable when attached to the fabric and which are basically made of a metal.

Solution to Problem

To solve the above problems, according to one aspect of the present invention, there is provided a male snap button including a male snap body made of metal, and a fixing member configured for fixing the male snap body to a fabric, in which the male snap body includes a male-side engagement part in annular shape that is capable of being removably engaged with a female-side engagement part of a female snap button, and a plurality of claws. The male-side engagement part defines an opening that exposes the fabric inside in a radial direction thereof. A diameter of the opening is greater than a length in the radial direction from an outside edge of the opening in the radial direction to an outside edge of the male snap body in the radial direction. And, the fixing member includes a claw accommodation part configured to receive the plurality of claws.

In the present invention, the male snap button includes the male snap body made of metal and the fixing member. The male snap body includes the male-side engagement part and the plurality of claws, and the fixing member includes the claw accommodation part configured to receive the plurality of claws. The male-side engagement part defines the opening that exposes the fabric inside in the radial direction thereof, and the diameter of the opening is greater than the length in the radial direction from the outside edge of the opening in the radial direction to the outside edge of the male snap body in the radial direction. The length in the radial direction from the outside edge of the opening in the radial direction to the outside edge of the male snap body in the radial direction is referred to as, in other words, a width of the male snap body surrounding the opening in the radial direction (therefore, hereinafter also referred to as a "male snap body width"). In a case in which the male snap button is attached to the fabric, the plurality of claws of the male snap body penetrates the fabric from one surface side to another surface side, and on the other surface side of the fabric, the plurality of claws is accommodated in the claw accommodation part of the fixing member while being crimped. Accordingly, the male snap body is attached to the fabric together with the fixing member. In this state of being attached to the fabric, the male-side engagement part of the male snap body which is a portion other than the claws appears on the one surface side of the fabric, and the fixing member is applied from the other surface side of the fabric. In a state in which the male snap button is attached to the fabric, the fabric surface is exposed to the outside from the opening, but since the diameter of the opening is larger than the male snap body width, it is possible to relatively largely expose one surface side of the fabric on the male snap body side. In this way, the male snap body width is small as compared with the diameter of the opening that exposes the fabric while it is possible to make the fabric noticeable, and thus it is possible to make the male snap body inconspicuous on the fabric.

In one embodiment of the present invention, the male-side engagement part includes an inside peripheral wall that defines the opening, and the plurality of claws extends from the inside peripheral wall. In the present embodiment, the inside peripheral wall of the male-side engagement part is located furthest inside in the radial direction in the male snap body and defines the opening. In addition, each claw extends from the inside peripheral wall. Therefore, a proximal edge of each claw is located at the same position as the inside peripheral wall in the radial direction. Accordingly, other portions of the male snap body are not present inside the inside peripheral wall and the proximal edges of the claws in the radial direction in the male snap body, and the opening of the inside peripheral wall for exposing the fabric can be set as large as possible.

In the present invention, the male snap body is formed of a metal such as aluminum, an aluminum alloy, copper, a copper alloy, iron, or stainless steel, but the present invention is not limited thereto. The fixing member can be formed of the same metal as the male snap body, a thermoplastic resin, or the like. The number of the claws included in the fixing member is at least two, preferably three or more, and particularly preferably four to six, but the present invention is not limited thereto.

According to another aspect of the present invention, there is provided a female snap button including a female snap body, and a fixing member configured for fixing the female snap body to a fabric, in which the female snap body includes a female-side engagement member in annular shape that is capable of being removably engaged with a male-side engagement part of a male snap button, an annular member made of metal including a holding part that holds the female-side engagement member, and a plurality of claws made of metal. The female-side engagement member or the annular member defines an opening that exposes the fabric inside in a radial direction thereof. A diameter of the opening is greater than a length in the radial direction from an outside edge of the opening in the radial direction to an outside edge of the female snap body in the radial direction. And, the fixing member includes a claw accommodation part configured to receive the plurality of claws.

In the present invention, the female snap button includes the female snap body and the fixing member. The female snap body includes the female-side engagement member, the annular member made of metal, and the plurality of claws made of metal. And, the annular member includes the holding part that holds the female-side engagement member. The female-side engagement member or the annular member defines the opening that exposes the fabric inside in the radial direction thereof. And, the diameter of the opening is greater than the length in the radial direction from the outside edge of the opening in the radial direction to the outside edge of the female snap body in the radial direction (hereinafter also referred to as a "female snap body width"). In a case in which the female snap button is attached to the fabric, the plurality of claws of the female snap body penetrates the fabric from one surface side to another surface side, and on the other surface side of the fabric, the plurality of claws is accommodated in the claw accommodation part of the fixing member while being crimped. Accordingly, the female snap body is attached to the fabric together with the fixing member. In this state of being attached to the fabric, the annular member of which the holding part holds the female-side engagement member of the female snap body which is a portion other than the claws appears on the one surface side of the fabric, and the fixing member is applied from the other surface side of the fabric. In a state in which the female snap button is attached to the fabric, the fabric surface is exposed to the outside from the opening, but since the diameter of the opening is larger than the female snap body width, it is possible to relatively largely expose one surface side of the fabric on the female snap body side. In this way, the male snap body width is small as compared with the diameter of the opening that exposes the fabric while it is possible to make the fabric noticeable, and thus it is possible to make the female snap body inconspicuous on the fabric.

In the present invention, in a case in which the female-side engagement member defines the opening, the radially inside edge of the female-side engagement member is located inside the radially inside edge of the annular member in the radial direction. Further, in a case in which the annular member defines the opening, the radially inside edge of the annular member is located inside the radially inside edge of the female-side engagement member in the radial direction.

In one embodiment of the present invention, the annular member includes a bottom wall, the plurality of claws extends from a radially inside edge of the bottom wall, and the radially inside edge of the bottom wall and proximal edges of the plurality of claws define the opening. In the present embodiment, the bottom wall of the annular member extends furthest inward in the female snap body in the radial direction, each claw extends from the radially inside edge of the bottom wall, and the radially inside edge of the bottom wall and the proximal edges of the plurality of the claws define the opening. Therefore, other portions or members of the female snap body are not present inside the bottom wall and the proximal edges of the claws in the radial direction in the female snap body, and the opening for exposing the fabric can be set as large as possible.

In the present invention, the annular member and the claw member of the female snap body which are portions other than the female-side engagement member are formed of a metal such as aluminum, an aluminum alloy, copper, a copper alloy, iron, or stainless steel, but the present invention is not limited thereto. The female-side engagement member is formed of a thermoplastic resin, a thermosetting resin, or the same metal as the annular member and the claw member, but the present invention is not limited thereto. The fixing member can be formed of the same metal as the annular member and the claw member, a thermoplastic resin, or the like. The number of the claws included in the fixing member is at least two, preferably three or more, and particularly preferably four to six, but the present invention is not limited thereto.

Advantageous Effects of Invention

In the present invention, in the male snap button and the female snap button which are basically made of a metal, by making the diameter of the opening that exposes the fabric larger than the male or female snap body width to relatively largely expose the fabric while hiding the fabric with the male or female snap body as little as possible, it is possible to make the fabric more noticeable.

DESCRIPTION OF EMBODIMENTS

Hereinafter, preferable embodiments of the present invention will be described, but the present invention is not limited to such embodiments and can be appropriately modified within the scope of claims and the equivalent thereof.

Figure 1:
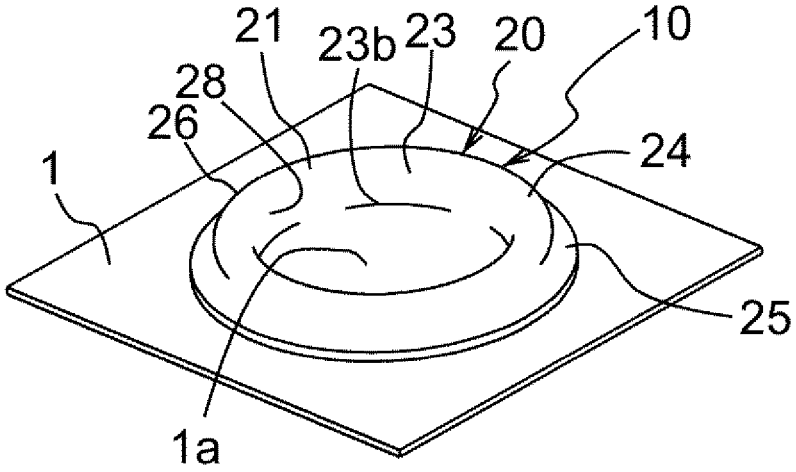
FIG. 1 is a perspective view showing a male snap button according to an embodiment of the present invention when attached to a fabric.
Figure 2:
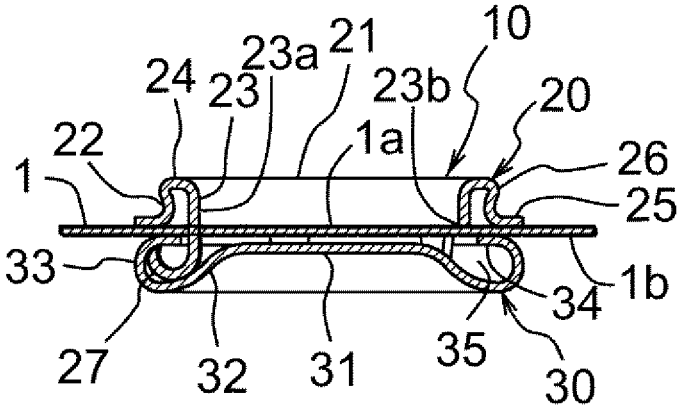
FIG. 2 is a cross-sectional view of the male snap button in FIG. 1.
Figure 3:
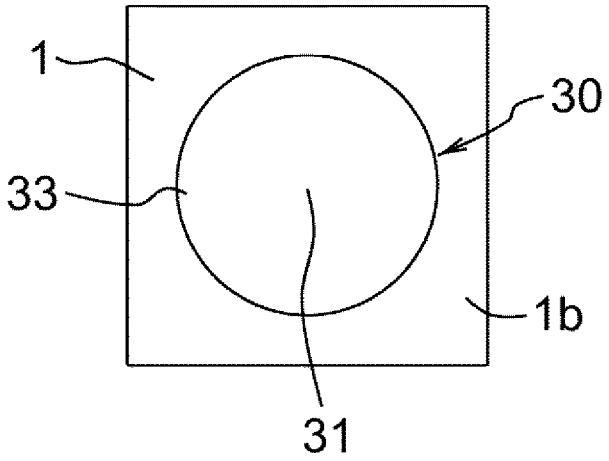
FIG. 3 is a plan view of the male snap button attached to the fabric from a fixing member side.
Figure 4:
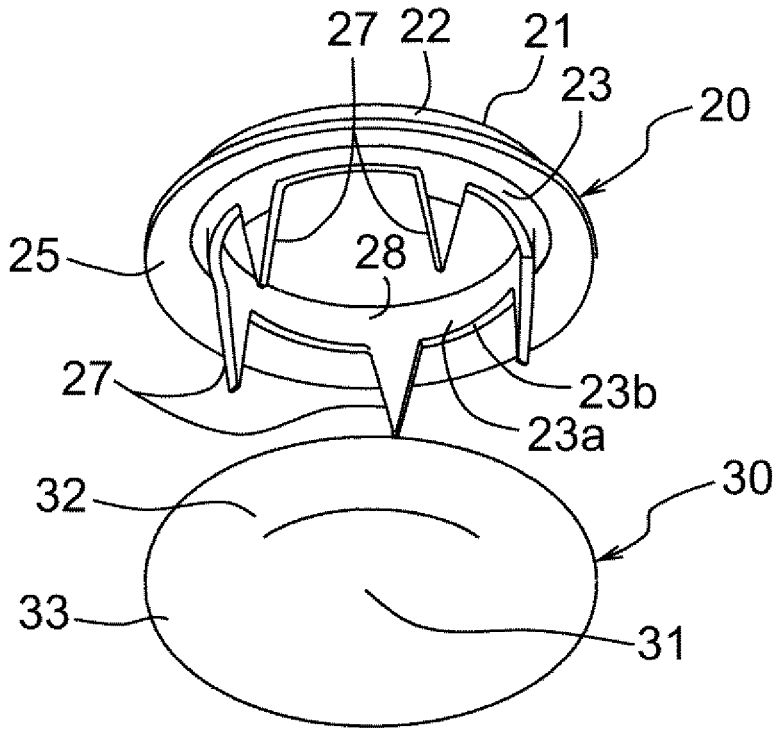
FIG. 4 is a perspective view showing a male snap body and a fixing member before being attached to the fabric.
Figure 5:
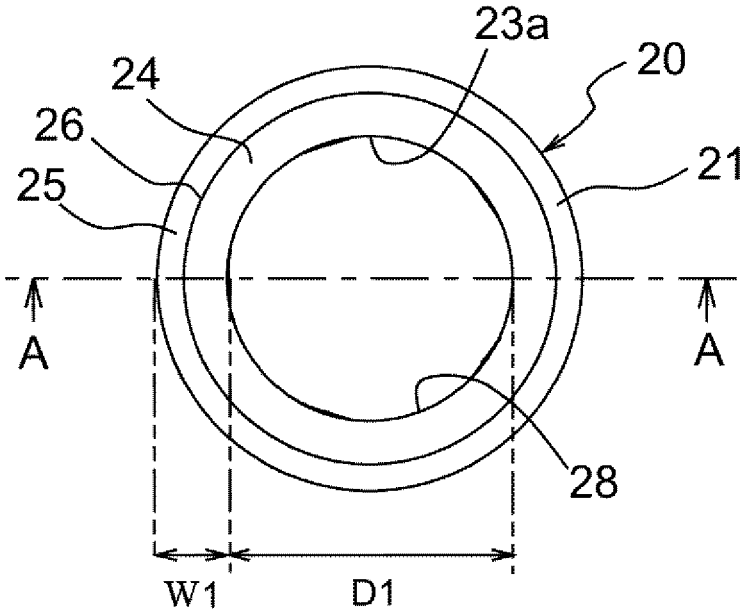
FIG. 5 is a plan view of the male snap body.
Figure 6:
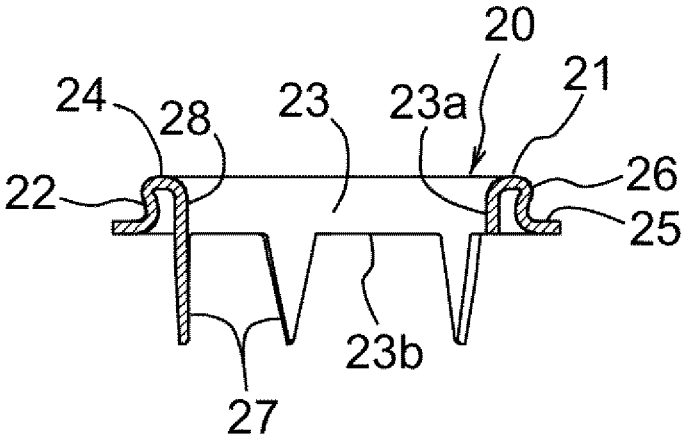
FIG. 6 is a cross-sectional view of the male snap body along line A-A in FIG. 5.
Figure 7:
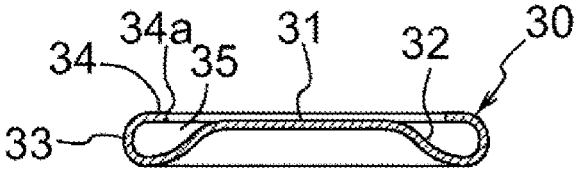
FIG. 7 is a cross-sectional view of the fixing member.

FIGS. 1 and 2 are a perspective view and a cross-sectional view showing a male snap button 10 according to an embodiment of the present invention when attached to a fabric 1. The male snap button 10 includes two components, i.e., a male snap body 20 and a fixing member 30. FIG. 3 is a plan view of the male snap button 10 attached to the fabric 1 from a fixing member 30 side. FIG. 4 is a perspective view showing the male snap body 20 and the fixing member 30 before being attached to the fabric 1. FIG. 5 is a plan view of the male snap body 20. FIG. 6 is a cross-sectional view of the male snap body 20 along line A-A in FIG. 5. FIG. 7 is a cross-sectional view of the fixing member 30.

In the following description of the male snap body 20, a vertical direction is based on a paper surface of FIG. 6. The male snap body 20 is a single member formed by subjecting a metal plate material to drawing processing and includes an annular male-side engagement part 21 and claws 27 which extend axially downward from the male-side engagement part 21 and of which the number is five as an example. The male-side engagement part 21 is a portion that removably engages with a female-side engagement member 60 which is a male-side engagement part of a female snap button 40 which will be described later. The male-side engagement part 21 appears on an upper surface (one surface) 1*a* of the fabric 1 in a state in which the male snap button 10 is attached to the fabric 1. The fixing member 30 is applied to a lower surface (another surface) 1*b* of the fabric 1. With reference to FIGS. 2, 6, and the like, the male-side engagement part 21 of the male snap body 20 includes an outside peripheral wall 22, an inside peripheral wall 23, a connecting part 24 that connects upper edges of the outside and inside peripheral walls 22 and 23, and an annular flange 25 that extends outward from a lower edge of the outside peripheral wall 22 in a radial direction. The annular flange 25 extends furthest outward in the male snap body 20 in the radial direction. A gap is present between the outside peripheral wall 22 and the inside peripheral wall 23. The outside peripheral wall 22 has an engagement head 26 in an upper edge portion of which an outer diameter becomes maximum.

The inside peripheral wall 23 is located furthest inside in the radial direction in the male-side engagement part 21, and an inner peripheral surface 23*a* of the inside peripheral wall 23 defines a circular opening 28 that opens vertically. With reference to FIG. 5, a diameter D1 of the opening 28 is greater than a length (a male snap body width) W1 in the radial direction from an outside edge of the opening 28 in the radial direction to an outside edge of the male snap body 20 in the radial direction, that is, to an outside edge of the annular flange 25 in the radial direction. In the present embodiment, D1 is about three times W1. In a state in which the male snap body 20 is attached to the fabric 1, the upper surface 1*a* of the fabric 1 is exposed to the outside from the opening 28 (see FIG. 1). Therefore, a user can see the upper surface 1*a* of the fabric 1 that appears inside the inside peripheral wall 23 in the radial direction. Each claw 27 extends continuously downward from a lower edge 23*b* of the inside peripheral wall 23 of the male-side engagement part 21. The claws 27 are provided in the lower edge 23*b* of the inside peripheral wall 23 at equal intervals in a circumferential direction. A width of each claw 27 in the circumferential direction is reduced from a proximal edge on an upper side toward a lower side, and a lower edge (a tip edge) thereof becomes sharp. In the present example, each claw 27 extends substantially parallel to an axis of the male snap body 20. A position of the proximal edge (an upper edge) of each claw 27 in the radial direction is substantially the same as a position of the inside peripheral wall 23 of the male-side engagement part 21 in the radial direction. Therefore, in the male snap body 20, the inside peripheral wall 23 and the proximal edges of the claws 27 are furthest inside in the radial direction, and other portions of the male snap body 20 are not inside the inside peripheral wall 23 and the proximal edges of the claws 27 in the radial direction. Accordingly, it is possible to relatively widely expose the fabric in a circular region inside the inside peripheral wall 23 and the claws 27 in the radial direction without largely hiding the upper surface 1*a* of the fabric 1 with the male-side engagement part 21 in a state in which the male snap body 20 is attached to the fabric 1. When the male snap button 10 is attached to the fabric 1, each claw 27 penetrates the fabric 1 from the upper surface 1*a* side to the lower surface 1*b* side and then is received in a claw accommodation part 33, which will be described later, of the fixing member 30 while being bent.

In the following description of the fixing member 30, a vertical direction is based on a paper surface of FIG. 7. The fixing member 30 includes a central part 31 which has a substantially flat and circular shape, an annular inclined part 32 that extends outward in the radial direction and downward from an outside edge of the central part 31 in the radial direction, and a claw accommodation part 33 that further extends outward in the radial direction from the annular inclined part 32 and then is bent upward and inward in the radial direction to have a C shape. Characters, symbols, figures, and the like may be affixed to a lower surface of the central part 31 by printing, plating, engraving, and the like. In the case of engraving, unevenness may occur in upper and lower surfaces of the central part 31. Further, as will be described later, the central part 31 is opened (see FIG. 18), or, although not shown, the central part 31 is cut out in the shape of characters, symbols, figures, and the like, and thus it is possible to give a design of a through hole shape to the central part 31. The claw accommodation part 33 includes a substantially flat distal edge portion 34. The distal edge portion 34 is located slightly upward from the central part 31 in the vertical direction (an axial direction). A distal edge 34*a* of the distal edge portion 34 is located in the vicinity of a boundary between the annular inclined part 32 and the claw accommodation part 33 in the radial direction. The distal edge 34*a* of the claw accommodation part 33 is separated from the annular inclined part 32 (and other portions of the fixing member 30), an annular gap (35) between the distal edge 34*a* and the annular inclined part 32 becomes a receiving aperture 35 through which the claws 27 of the male snap body 20 which have penetrated the fabric 1 downward are received inside the claw accommodation part 33 of the fixing member 30 when the male snap button 10 is attached to the fabric 1.

In a case in which the male snap body 20 and the fixing member 30 that have not yet been attached to the fabric 1, that is, in an initial state, are disposed concentrically, the inside peripheral wall 23 and the claws 27 are located at a position corresponding to a portion between upper and lower edges of the annular inclined part 32 of the fixing member 30 in the radial direction. Further, the distal edge 34*a* of the claw accommodation part 33 of the fixing member 30 is located slightly outside the inside peripheral wall 23 and the claws 27 in the radial direction. A maximum outer diameter of the male snap body 20, that is, an outer diameter of the outside edge of the annular flange 25 in the radial direction, is substantially the same as a maximum outer diameter of the fixing member 30, that is, a maximum outer diameter of the claw accommodation part 33.

In the following description of the attachment of the male snap button 10 to the fabric 1, a vertical direction is based on a paper surface of FIG. 2. In a case in which the male snap button 10 is attached to the fabric 1 as shown FIG. 2, the male snap body 20 is held on an upper die of a button attachment device (not shown), the fixing member 30 is set on a lower die thereof, and the fabric 1 is arranged on the fixing member 30. When the upper die is lowered from this state, each claw 27 of the male snap body 20 penetrates the fabric 1 downward, and then the tip edge of each claw 27 butts against the annular inclined part 32 of the fixing member 30. Next, each claw 27 is guided from the receiving aperture 35 to the inside of the claw accommodation part 33 while being curved outward in the radial direction along an inclined upper surface of the annular inclined part 32 and is crimped to be bent in a C shape along an inner surface of the claw accommodation part 33. In this way, by each claw 27 of the male snap body 20 being crimped inside the claw accommodation part 33, the male snap body 20 is attached to the fabric 1 together with the fixing member 30 (see FIG. 2). In a state in which the male snap body 20 is attached to the fabric 1, the male-side engagement part 21 appears in an annular shape on the upper surface 1*a* of the fabric 1 (see FIG. 1), and the annular flange 25 abuts on the upper surface 1*a* of the fabric 1. Further, the lower edge 23*b* of the inside peripheral wall 23 of the male-side engagement part 21 abuts on the upper surface 1*a* of the fabric 1, and the upper surface 1*a* of the fabric 1 is exposed to the outside from the opening 28 defined by the inner peripheral surface 23*a* of the inside peripheral wall 23. As described above, since the diameter D1 of the opening 28>the male snap body width W1, the male-side engagement part 21 of the male snap body 20 is relatively inconspicuous on the fabric 1, and since the upper surface 1*a* is exposed substantially without being hidden, it is possible to make the fabric 1 noticeable as compared with the snap button of the related art. Further, by providing the claws 27 on the male snap body 20 and providing the claw accommodation part 33 in the fixing member 30, it is possible to reduce a thickness (a height) of the male-side engagement part 21 on the fabric 1.

Figure 8:
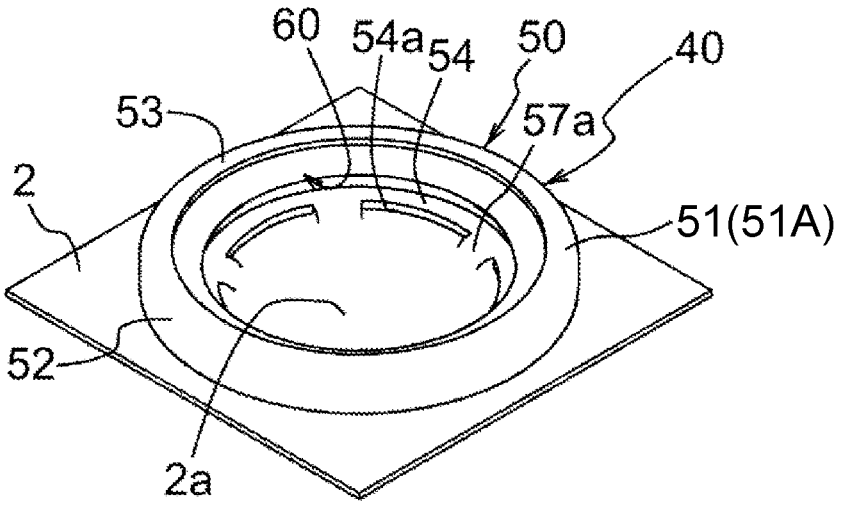
FIG. 8 is a perspective view showing a female snap button according to an embodiment of the present invention when attached to the fabric.
Figure 9:
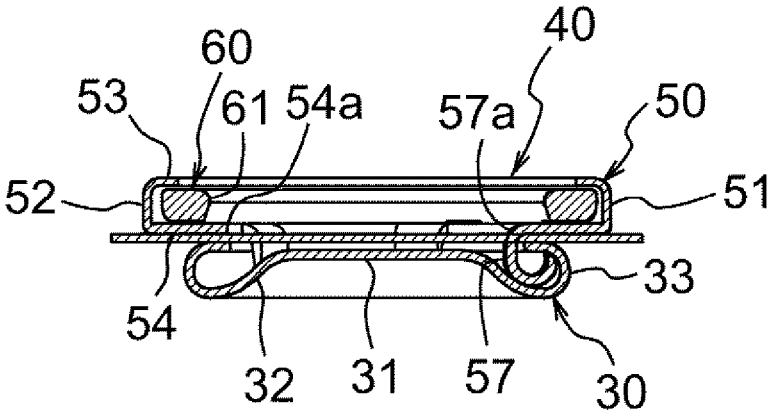
FIG. 9 is a cross-sectional view of the female snap button in FIG. 8.
Figure 10:
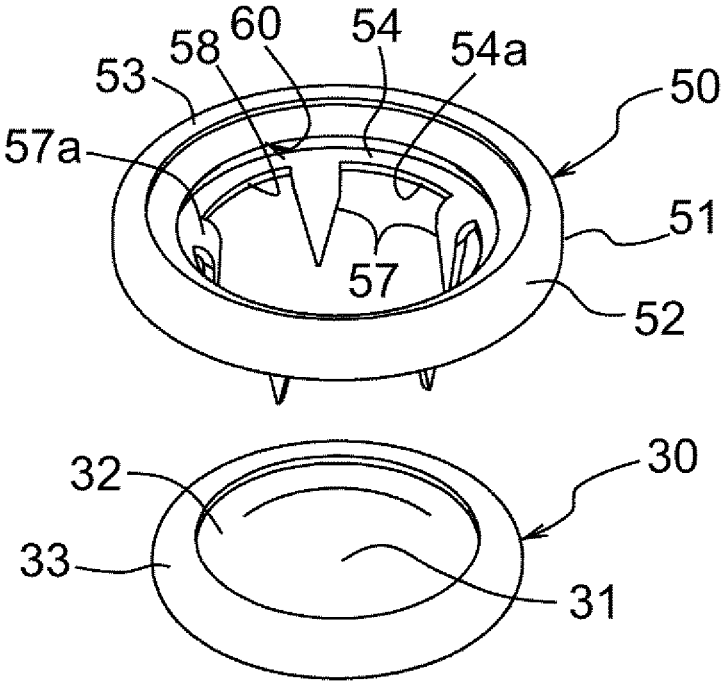
FIG. 10 is a perspective view showing a female snap body and a fixing member before being attached to the fabric.
Figure 11:
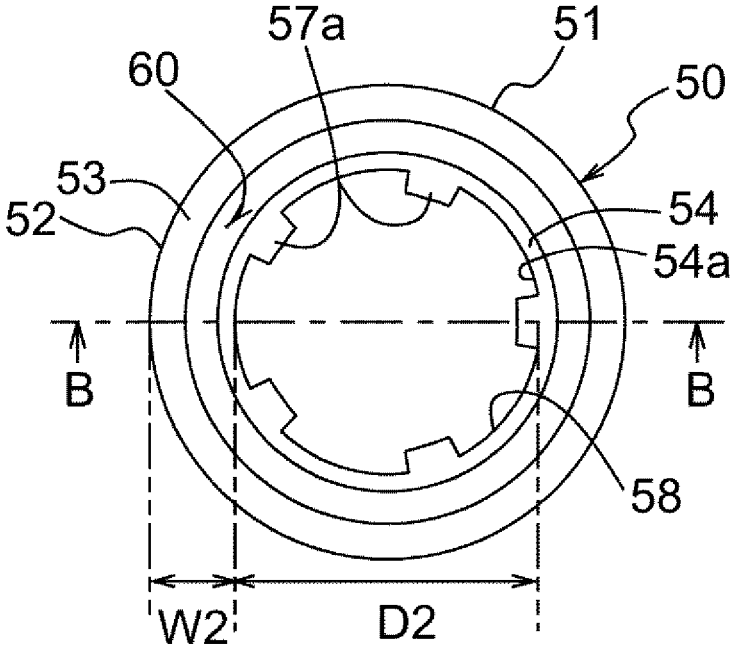
FIG. 11 is a plan view of the female snap body.
Figure 12:
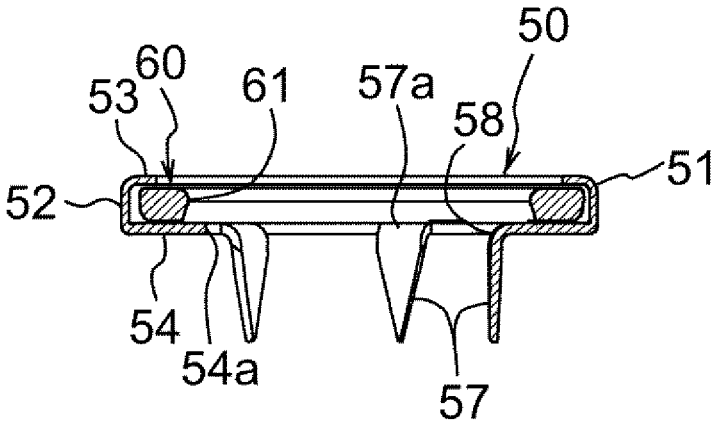
FIG. 12 is a cross-sectional view of the female snap body 50 along line B-B in FIG. 11.

FIGS. 8 and 9 are a perspective view and a cross-sectional view showing a female snap button 40 according to an embodiment of the present invention when attached to fabric 2. The female snap button 40 includes two members, i.e., a female snap body 50 and a fixing member 30. The fixing member 30 is a common member to the fixing member 30 of the male snap button 10 described above. FIG. 10 is a perspective view showing the female snap body 50 and the fixing member 30 before being attached to the fabric 2. FIG. 11 is a plan view of the female snap body 50. FIG. 12 is a cross-sectional view of the female snap body 50 along line B-B in FIG. 11.

Figure 13:
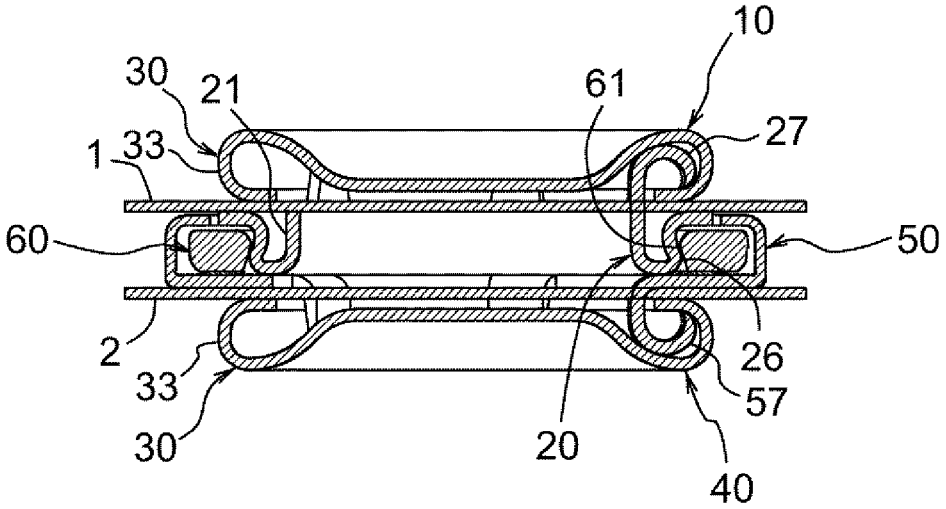
FIG. 13 is a cross-sectional view showing the male snap button and the female snap button when engaged with each other.

In the following description of the female snap body 50, a vertical direction is based on a paper surface of FIG. 12. The female snap body 50 includes a female-side engagement member 60 having an annular shape or a C shape, an annular member 51A made of metal including a holding part 51 that holds the female-side engagement member 60, and claws 57 made of metal that extend axially downward from the annular member 51A and of which the number is five as an example. The female-side engagement member 60 is made of a resin or a metal and is a member that removably engages with the male-side engagement part 21 of the male snap button 10 described above. FIG. 13 is a cross-sectional view showing the male snap button 10 and the female snap button 40 when engaged with each other. The female-side engagement member 60 has an engagement edge 61 at which an inner diameter thereof becomes minimum slightly above a middle thereof in the vertical direction. At the time of detachment and engagement of the male snap button 10 and the female snap button 40, when the engagement head 26 of the male-side engagement part 21 moves beyond the engagement edge 61 of the female-side engagement member 60 in one direction or another direction of the axial direction, the female-side engagement member 60 can be temporarily and elastically expanded outward in the radial direction. The annular member 51A and the claws 57 are a single member formed by drawing a metal plate material. The annular member 51A appears on an upper surface (one surface) 2*a* of the fabric 2 together with the female-side engagement member 60 in a state in which the female snap button 40 is attached to the fabric 2. The fixing member 30 is applied to a lower surface (another surface) 2*b* of the fabric 2. With reference to FIGS. 9, 12, and the like, the annular member 51A includes the holding part 51 that holds the female-side engagement member 60. The Holding part 51 includes a peripheral side wall 52, a top wall 53 that extends inward from an upper edge of the peripheral side wall 52, and a bottom wall 54 that extends inward from a lower edge of the peripheral side wall 52 in the radial direction. The female-side engagement member 60 is accommodated between the top wall 53 and the bottom wall 54. The top wall 53 covers an outside portion of the female-side engagement member 60 in the radial direction. The bottom wall 54 extends inward in the radial direction beyond a width of the female-side engagement member 60 in the radial direction. Strictly speaking, a portion in the bottom wall 54 which extends inside the female-side engagement member 60 in the radial direction is a part of the annular member 51A but not a part of the holding part 51. That is, in the present embodiment, the annular member 51A includes the holding part 51 and the portion in the bottom wall 54 which extends inside the female-side engagement member 60 in the radial direction. In an initial state as in FIG. 12 and the like, a slight gap is present between the female-side engagement member 60 and the peripheral side wall 52, and this gap allows the female-side engagement member 60 to elastically expand outward in the radial direction.

In the present embodiment, the bottom wall 54 extends inside the top wall 53 in the radial direction. The bottom wall 54 and top wall 53 may extend inward in the radial direction to substantially the same extent. Each claw 57 extends continuously downward from a radially inside edge 54*a* of the bottom wall 54. The radially inside edge 54*a* of the bottom wall 54 defines a substantially circular opening 58 that opens vertically, together with the proximal edge (the upper edge) 57*a* of each claw 57. With reference to FIG. 11, a diameter D2 of the opening 58 is greater than a length (a female snap body width) W2 in the radial direction from an outside edge of the opening 58 in the radial direction to the peripheral side wall 52 which is an outside edge of the female snap body 50 in the radial direction. In the present embodiment, D2 is about three times W2. In a state in which the female snap button 40 is attached to the fabric 2, the upper surface 2*a* of the fabric 2 is exposed to the outside from the opening 58 (see FIG. 8), and on the fabric 2, the proximal edge 57*a* of each claw 57 is slightly inside the radially inside edge 54*a* of the bottom wall 54 in the radial direction. The user can see the upper surface 2*a* of the fabric 2 that is exposed from the opening 58. The claws 57 are provided in the radially inside edge 54*a* of the bottom wall 54 at equal intervals in the circumferential direction. A width of each claw 57 in the circumferential direction is reduced toward a lower side, and a lower edge (a tip edge) thereof becomes sharp. Each claw 57 extends substantially parallel to an axis of the female snap body 50. Therefore, a position of each claw 57 in the radial direction is substantially the same as a position of the radially inside edge 54*a* of the bottom wall 54 of the holding part 51 in the radial direction. In the present embodiment, each claw 57 extends downward while being bent to slightly protrude inward from the radially inside edge 54*a* of the bottom wall 54 in the radial direction. Therefore, in the female snap body 50, the proximal edges 57*a* of the claws 57 are furthest inside in the radial direction, and other portions or members of the female snap body 50 are not inside the proximal edges 57*a* in the radial direction. Further, as described above, since the diameter D2 of the opening 58>the female snap body width W2, it is possible to make the fabric 2 noticeable by exposing the upper surface 2*a* from the opening 58 without largely hiding the upper surface 2*a* by the annular member 51A and the female-side engagement member 60 in a state in which the female snap body 50 is attached to the fabric 2. When the female snap button 40 is attached to the fabric 2, each claw 57 penetrates the fabric 2 from the upper surface 2*a* side to the lower surface 2*b* side and then is received in the claw accommodation part 33 of the fixing member 30 while being bent.

In a case in which the female snap body 50 and the fixing member 30 that have not yet been attached to the fabric 2, that is, in an initial state, are disposed concentrically, the claws 57 are located at a position corresponding to a portion between upper and lower edges of the annular inclined part 32 of the fixing member 30 in the radial direction.

In the following description of the attachment of the female snap button 40 to the fabric 2, a vertical direction is based on a paper surface of FIG. 9. In a case in which the female snap button 40 is attached to the fabric 2 as shown FIG. 8, the female snap body 50 is held on an upper die of a button attachment device (not shown), the fixing member 30 is set on a lower die thereof, and the fabric 2 is arranged on the fixing member 30. When the upper die is lowered from this state, each claw 57 of the female snap body 50 penetrates the fabric 2 downward, and then the tip edge of each claw 57 butts against the annular inclined part 32 of the fixing member 30. Next, each claw 57 is guided from the receiving aperture 35 to the inside of the claw accommodation part 33 while being curved outward in the radial direction along an inclined upper surface of the annular inclined part 32 and is crimped to be bent in a C shape along an inner surface of the claw accommodation part 33. In this way, by each claw 57 of the female snap body 50 being crimped inside the claw accommodation part 33, the female snap body 50 is attached to the fabric 2 together with the fixing member 30 (see FIG. 9). In a state in which the female snap body 50 is attached to the fabric 2, the annular member 51A which holds the female-side engagement member 60 with the holding part 51 appears in an annular shape on the upper surface 2*a* of the fabric 2 (see FIG. 8), and the bottom wall 54 of the annular member 51A abuts on the upper surface 2*a* of the fabric 2. Further, the upper surface 2*a* of the fabric 2 is exposed to the outside from the opening 58 defined by the radially inside edge 54*a* of the bottom wall 54 and the proximal edges 57*a* of the claws 57. As described above, since the diameter D2 of the opening 58>the female snap body width W2, the annular member 51A and the female-side engagement member 60 expose the upper surface 2*a* of the fabric 2 substantially without hiding the upper surface 2*a* of the fabric 2, and thus it is possible to make the fabric 2 noticeable without the female snap body 50 being noticeable on the fabric 2 as compared with the snap button of the related art. Further, by providing the claws 57 on the female snap body 50 and providing the claw accommodation part 33 in the fixing member 30, it is possible to reduce a thickness (a height) of the holding part 51 on the fabric 2.

Figure 14:
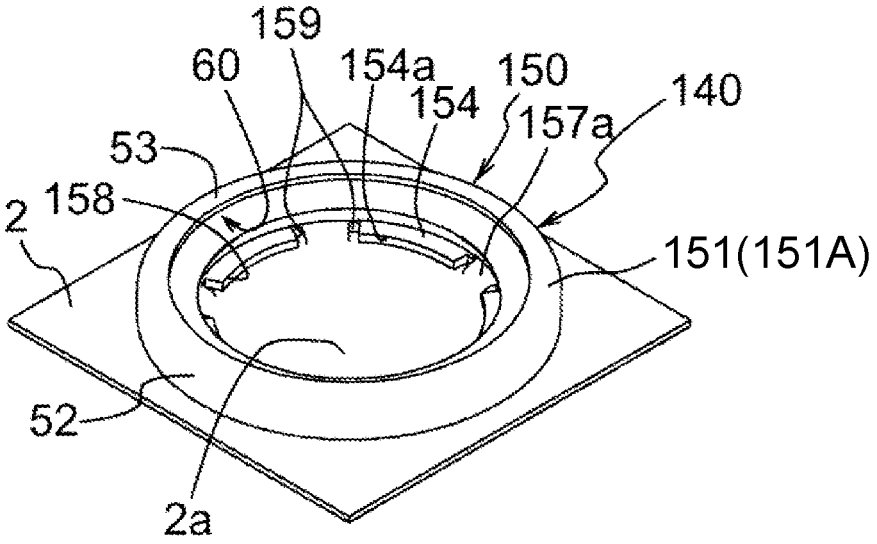
FIG. 14 is a perspective view showing a female snap button according to another embodiment of the present invention when attached to the fabric.
Figure 15:
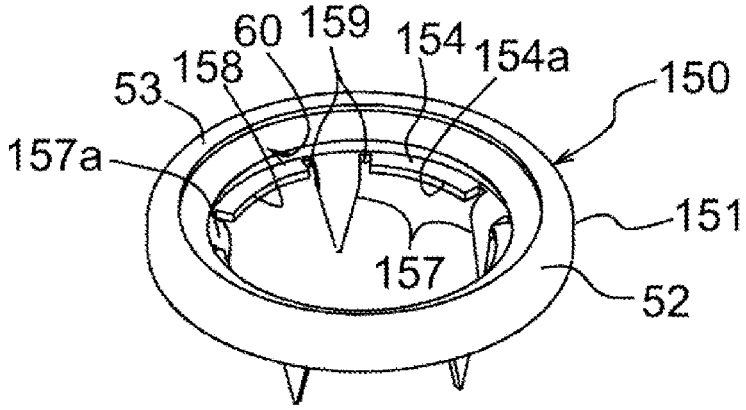
FIG. 15 is a perspective view showing a female snap body before being attached to the fabric.
Figure 16:
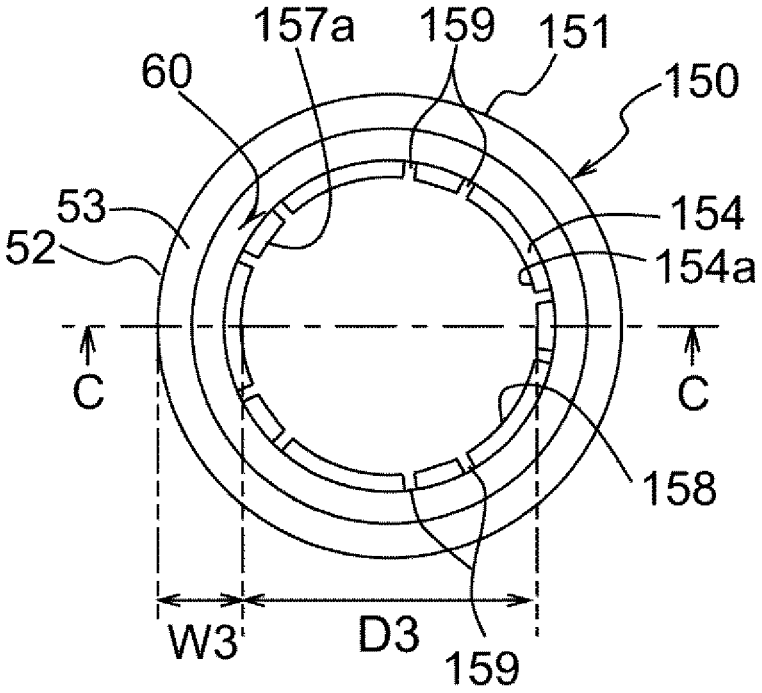
FIG. 16 is a plan view of the female snap body.
Figure 17:
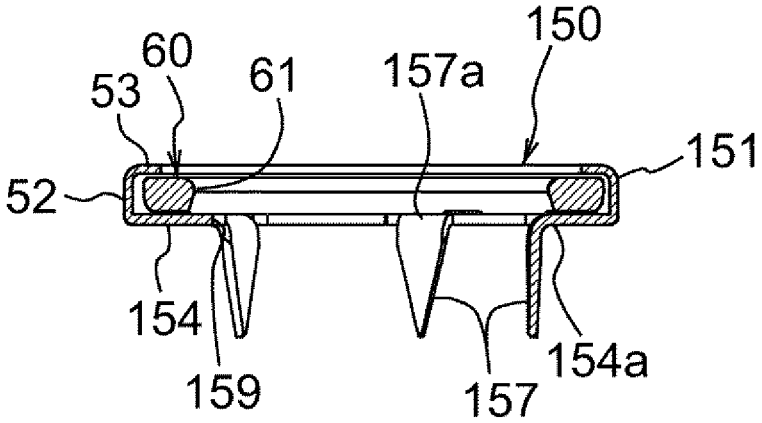
FIG. 17 is a cross-sectional view of the female snap body along line C-C in FIG. 16.

FIG. 14 is a perspective view showing a female snap button 140 according to another embodiment of the present invention when attached to the fabric 2 (the same reference sign is used because the fabric is the same as the fabric 2 in FIG. 8). The female snap button 140 includes two members, i.e., a female snap body 150 and the same fixing member 30 as described above. FIG. 15 is a perspective view showing a female snap body 150 before being attached to the fabric 2. FIG. 16 is a plan view of the female snap body 150. FIG. 17 is a cross-sectional view of the female snap body 150 along line C-C in FIG. 16. In the following description of the female snap body 150, a vertical direction is based on a paper surface of FIG. 17. Similar to the female snap body 50 described above, the female snap body 150 includes the female-side engagement member 60, an annular member 151A including the holding part 151, and claws 157 that extend axially downward from the annular member 151A and of which the number is five as an example. The female snap body 150 is different from the female snap body 50 in proximal edges 157*a* of the claws 157 and a radially inside edge 154*a* of the bottom wall 154 of the annular member 151A in the female snap body 150 as will be described below. Except for these differences, the female snap body 150 has a configuration substantially common to the female snap body 50. Therefore, the same reference signs are used with respect to the female-side engagement member 60, and the peripheral side wall 52 and the top wall 53 of the holding part 151, and description of common portions is omitted.

In the bottom wall 154 of the annular member 151A of the female snap body 150, the radially inside edge 154*a* thereof is provided with a set of two slits 159 in the radial direction on both sides of the proximal edge 157*a* of each claw 157 in the circumferential direction (both sides of the proximal edge 157*a* of the annular member 151A in the circumferential direction). Each slit 159 is slightly indented outward from the radially inside edge 154*a* of the bottom wall 154 in the radial direction. In the present embodiment, each claw 157 extends downward while being bent to slightly protrude inward in the radial direction between each set of slits 159 of the bottom wall 154. In a portion between each set of slits 159 of the bottom wall 154 (hereinafter referred to as an "inter-slit portion"), the radially inside edge 154*a* of the bottom wall 154 is a virtual line in the circumferential direction connecting outside edges of the slits 159 in the radial direction, and each claw 157 starts to extend from this virtual line. In the female snap body 150, a position of the proximal edge 157*a* of each claw 157 in the radial direction is slightly shifted outward in the radial direction by the amount of the provided slit 159 as compared with the female snap body 50. The radially inside edge 154*a* of the bottom wall 154 in a portion other than the inter-slit portion of the bottom wall 154 (hereinafter referred to as a "non-inter-slit portion") is located inside the radially inside edge 154*a* (the above-described virtual line) of the inter-slit portion in the radial direction. In state in which the female snap body 150 is attached to the fabric 2, as can be seen from FIG. 16, the proximal edge 157*a* of each claw 157 is located at substantially the same position in the radial direction as the radially inside edge 154*a* of the bottom wall 154 of the non-inter-slit portion. The proximal edge 157*a* of each claw 157 and the radially inside edge 154*a* of the non-inter-slit portion of the bottom wall 154 define a substantially circular opening 158 that opens vertically. With reference to FIG. 16, a diameter D3 of the opening 158 is greater than a length (a female snap body width) W3 in the radial direction from an outside edge of the opening 158 in the radial direction to the peripheral side wall 52 which is an outside edge of the female snap body 150 in the radial direction. In the present embodiment, D3 is about three times W3. In a state in which the female snap button 140 is attached to the fabric 2, the upper surface 2*a* of the fabric 2 is exposed to the outside from the opening 158 (see FIG. 14). Since the diameter D3 of the opening 158>the female snap body width W3, it is possible to make the fabric 2 noticeable by exposing the upper surface 2*a* from the opening 158 without largely hiding the upper surface 2*a* by the annular member 151A and the female-side engagement member 60 in a state in which the female snap body 150 is attached to the fabric 2.

Figure 18:
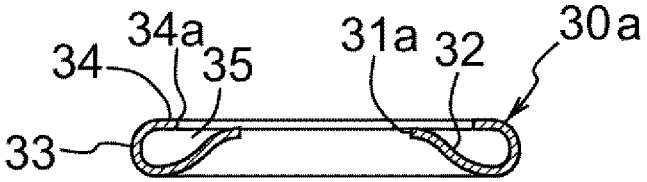
FIG. 18 is a cross-sectional view showing a modification example of the fixing member.

FIG. 18 is a cross-sectional view of a fixing member 30*a* which is a modification example of the fixing member 30. The fixing member 30*a* is obtained by a portion corresponding to the central part 31 of the fixing member 30 described above being cut to form an opening 31*a*. Except for the opening 31*a*, the fixing member 30*a* is common to the fixing member 30, and thus the same reference signs are used with respect to the annular inclined part 32 and the claw accommodation part 33, and description thereof is omitted. In a case in which this fixing member 30*a* is used, in a state in which the female snap button 140 is attached to the fabric 2, it is possible to expose the lower surface 2*b* of the fabric 2 from the opening 31*a* and to make the fabric 2 noticeable.

Figure 19:
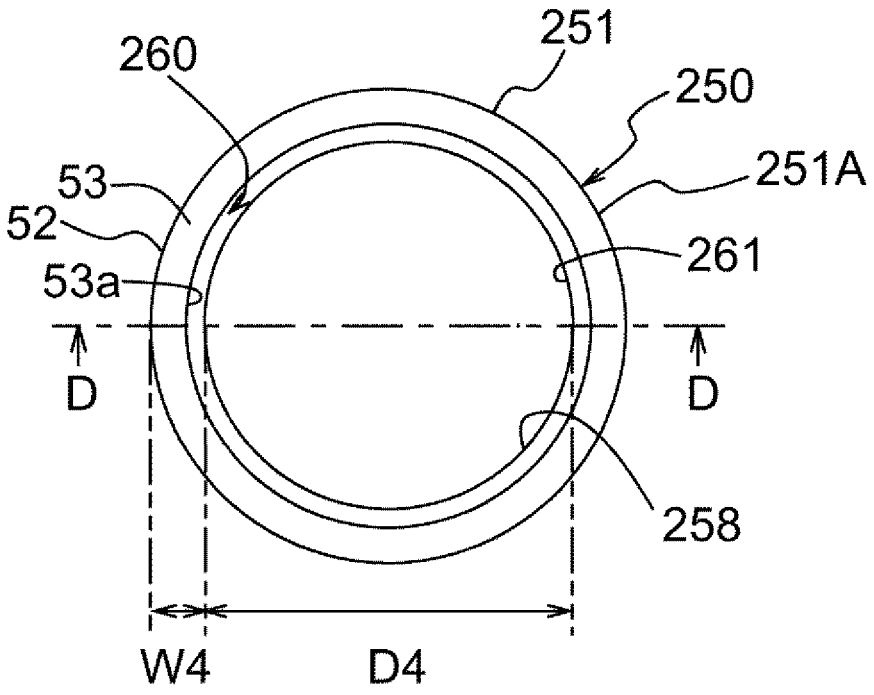
FIG. 19 is a plan view showing a modification example of the female snap body.
Figure 20:
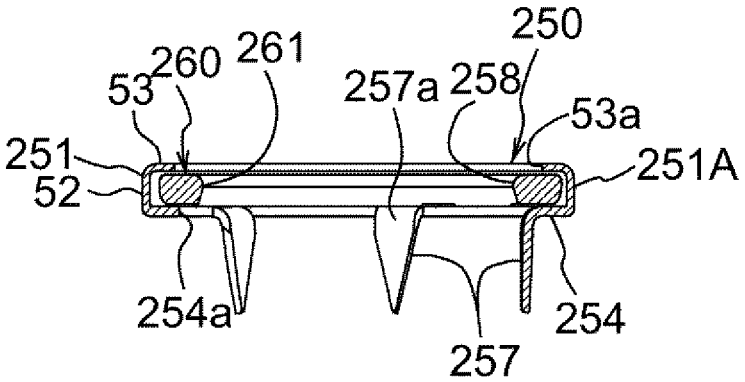
FIG. 20 is a cross-sectional view of the female snap body along line D-D in FIG. 19.

In the female snap button 40, 140 described above, the annular member 51A, 151A defines the opening 58, 158 that exposes the fabric 2, together with the proximal edges 57*a*, 157*a* of the claws 57, 157, but the female snap button according to the present invention is not limited to these embodiments, and as will be described below, a female-side engagement member 260 may define an opening 258. FIG. 19 is a plan view of a female snap body 250 in a female snap button according to a third embodiment of the present invention. FIG. 20 is a cross-sectional view along line D-D in FIG. 19. The fixing member 30 that constitutes the female snap button together with the female snap body 250 is substantially the same the fixing member 30 described above. The female snap body 250 includes an annular female-side engagement member 260, an annular member 251A including a holding part 251, and claws 257 that extend axially downward from the annular member 251A and of which the number is five as an example. In the present embodiment, since the entire portion of the annular member 251A becomes the holding part 251 and the top wall 53 and the peripheral side wall 52 of the holding part 251 are common to the top wall 53 and the peripheral side wall 52 of the holding part 51, the same reference signs are used. In the present embodiment, an engagement edge 261 which is a radially inside edge of the female-side engagement member 260 is located inside a radially inside edge 254*a* of the bottom wall 254 of the holding part 251 (the annular member 251A) in the radial direction. Further, the engagement edge 261 is located inside a radially inside edge 53*a* of the top wall 53 in the radial direction. Therefore, the engagement edge 261 of the female-side engagement member 260 defines an opening 258 that exposes the fabric. With reference to FIG. 19, a diameter D4 of the opening 258 is greater than a length (a female snap body width) W4 in the radial direction from an outside edge of the opening 258 in the radial direction to the peripheral side wall 52 which is an outside edge of the female snap body 250 in the radial direction. In the present embodiment, D4 is about four times W4. Although not shown, in a state in which the female snap body 250 is attached to the fabric, the upper surface of the fabric is exposed to the outside from the opening 258. At this time, a proximal edge 257*a* of the claw 257 is not seen or is difficult to be seen by the user due to the female-side engagement member 260. Since the diameter D4 of the opening 258>the female snap body width W4, it is possible to make the fabric noticeable by exposing the upper surface of the fabric from the opening 258 without largely hiding the upper surface of the fabric by the annular member 251A and the female-side engagement member 260.

REFERENCE SIGNS LIST

1, 2 Fabric
10 Male snap button
20 Male snap body
21 Male-side engagement part
22 Outside peripheral wall
23 Inside peripheral wall
23*a* Inner peripheral surface of inside peripheral wall
23*b* Lower edge of inside peripheral wall
26 Engagement head
27 Claw
28 Opening
30 Fixing member
32 Annular inclined part
33 Claw accommodation part
40, 140 Female snap button
50, 150, 250 Female snap body
51, 151, 251 Holding part
51A, 151A, 251A Annular member
54, 154, 254 Bottom wall
54*a*, 154*a*, 254*a* Radially inside edge of bottom wall
57, 157, 257 Claw

57*a*, 157*a*, 257*a* Proximal edge of claw

58, 158, 258 Opening

60, 260 Female-side holding member (female-side holding part)

61, 261 Engagement edge

159 Slit

The invention claimed is:

1. A male snap button (10) comprising:

a male snap body (20) made of metal; and a fixing member (30, 30*a*) configured for fixing the male snap body (20) to a fabric (1), wherein the male snap body (20) comprises:

a male-side engagement part (21) in annular shape, capable of being removably engaged with a female-side engagement part (60) of a female snap button (40, 140), and a plurality of claws (27), wherein the male-side engagement part (21) includes an outside peripheral wall (22), wherein the outside peripheral wall (22) has an engagement head (26) projecting to an outside of the outside peripheral wall (22) at an upper edge portion of which an outer diameter becomes maximum, wherein the male-side engagement part (21) defines an opening (28) that exposes the fabric (1) inside in a radial direction thereof, a diameter (D1) of the opening (28) is greater than a length (W1) in the radial direction from an outside edge of the opening (28) in the radial direction to an outside edge of the male snap body (20) in the radial direction, and the fixing member (30, 30*a*) comprises a claw accommodation part (33) configured to receive the plurality of claws (27).

2. The male snap button according to claim 1, wherein the male-side engagement part (21) comprises an inside peripheral wall (23) that defines the opening (28), and the plurality of claws (27) extends from the inside peripheral wall (23).

3. The male snap button according to claim 1, wherein the fixing member (30, 30*a*) comprises an annular inclined part (32) configured for guiding the plurality of claws (27) to the claw accommodation part (33).

4. A female snap button (40, 140) comprising:

a female snap body (50, 150, 250); and a fixing member (30, 30*a*) configured for fixing the female snap body (50, 150, 250) to a fabric (2), wherein the female snap body (50, 150, 250) comprises:

a female-side engagement member (60, 260) in annular shape, capable of being removably engaged with a male-side engagement part (21) of a male snap button (10), an annular member (51A, 151A, 251A) made of metal, including a holding part (51, 151, 251) that holds the female-side engagement member (60, 260), and a plurality of claws (57, 157, 257) made of metal, wherein the female-side engagement member (60, 260) or the annular member (51A, 151A, 251A) defines an opening (58, 158, 258) that exposes the fabric (2) inside in a radial direction thereof, a diameter (D2, D3, D4) of the opening (58, 158, 258) is greater than a length (W2, W3, W4) in the radial direction from an outside edge of the opening (58, 158, 258) in the radial direction to an outside edge of the female snap body (50, 150, 250) in the radial direction, and the fixing member (30, 30*a*) comprises a claw accommodation part (33) configured to receive the plurality of claws (57, 157, 257);

wherein the annular member (51A, 151A) comprises a bottom wall (54, 154), the plurality of claws (57, 157) extends from a radially inside edge (54*a*, 154*a*) of the bottom wall (54, 154), and the radially inside edge (54*a*, 154*a*) of the bottom wall (54, 154) and proximal edges (57*a*, 157*a*) of each of the plurality of claws (57, 157) define the opening (58, 158).

5. The male snap button according to claim 2, wherein the fixing member (30, 30*a*) comprises an annular inclined part (32) configured for guiding the plurality of claws (27) to the claw accommodation part (33).

* * * * *